US006625087B2

(12) United States Patent
Paratte

(10) Patent No.: US 6,625,087 B2
(45) Date of Patent: Sep. 23, 2003

(54) MEANS FOR LOADING OR EXTRACTING DATA FROM A PORTABLE OBJECT, SUCH AS, IN PARTICULAR, A TIMEPIECE

(75) Inventor: Daniel Paratte, Neuchâtel (CH)

(73) Assignee: ETA SA Fabriques d'Ebauches, Grenchen (CH)

( * ) Notice: Subject to any disclaimer, the term of this patent is extended or adjusted under 35 U.S.C. 154(b) by 287 days.

(21) Appl. No.: 09/809,272

(22) Filed: Mar. 16, 2001

(65) Prior Publication Data

US 2001/0022759 A1 Sep. 20, 2001

(30) Foreign Application Priority Data

Mar. 17, 2000 (CH) ..... 0513/00
Mar. 17, 2000 (EP) ..... 00200984

(51) Int. Cl.[7] ..... G04C 17/00; G04C 19/00; G04B 27/02; G04B 37/00

(52) U.S. Cl. ..... 368/69; 369/190; 369/308; 369/321

(58) Field of Search ..... 368/69.1, 185–187, 368/190, 319–321

(56) References Cited

U.S. PATENT DOCUMENTS 4,853,682 A * 8/1989 Asano et al. ..... 340/706
6,522,601 B2 * 2/2003 Sakuyama ..... 368/47

FOREIGN PATENT DOCUMENTS

DE 33 46 388 7/1985
DE 196 38 953 3/1998

OTHER PUBLICATIONS

Patent Abstracts of Japan, vol. 015, No. 420, Oct. 234, 1991 & JP 03 171360.
Patent Abstracts of Japan, vol. 002, No. 045, Mar. 27, 1978 & JP 53 009172.
Patent Abstracts of Japan, vol. 002, No. 011, Jan. 26, 1978 & JP 52 127361.

* cited by examiner

*Primary Examiner*—Vit Miska
(74) *Attorney, Agent, or Firm*—Sughrue Mion, PLLC

(57) ABSTRACT

A portable object such as, in particular, a timepiece, including an electronic movement carried by a printed circuit (20), this electronic movement including a time base circuit, a frequency divider circuit powered by the time base, a control circuit (22) connected to the divider circuit and a display system controlled by the control circuit, this portable object also including at least one push-button (8, 10) including a head (26) and a stem (16) passing through the middle part (4) of a case (2) closed by a back cover (6), characterized in that the push-button stem (16) can be electrically connected to a data input (42, 44) of the control circuit (22) by pressing on the push-button (8, 10), so that it is possible, via this stem (16), to enter data into said control circuit (22), originating from an electronic unit (45) for transmitting and receiving digital data such as a personal computer or PC or to extract data contained in said portable object.

16 Claims, 8 Drawing Sheets

Fig. 3
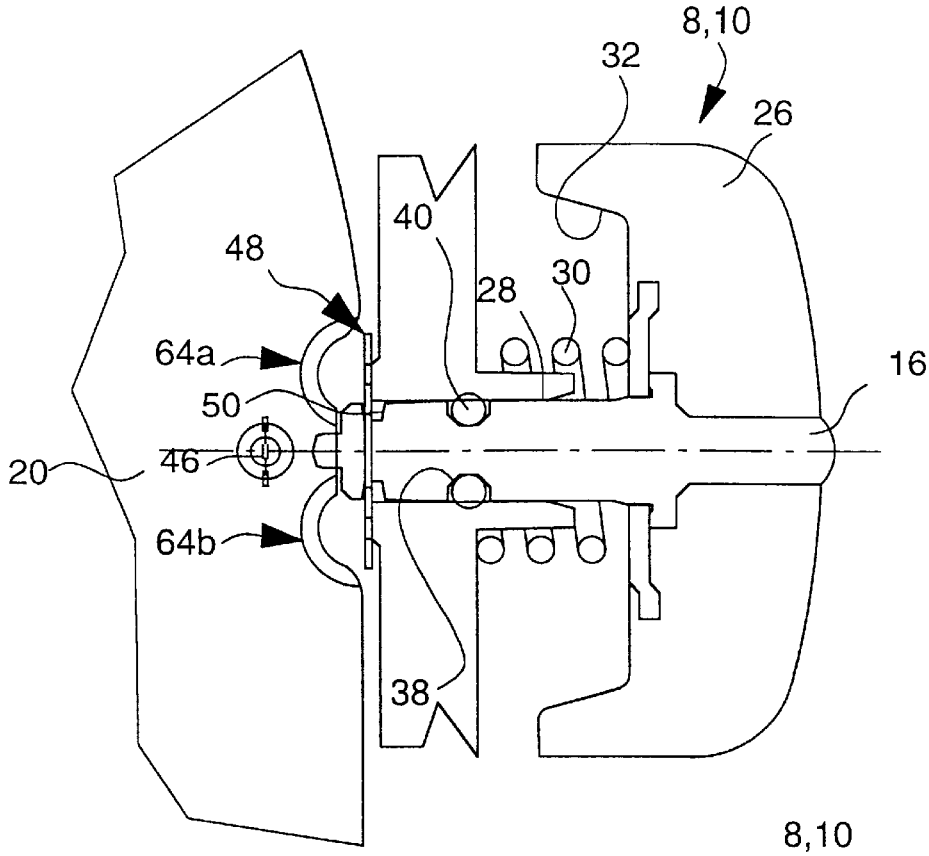
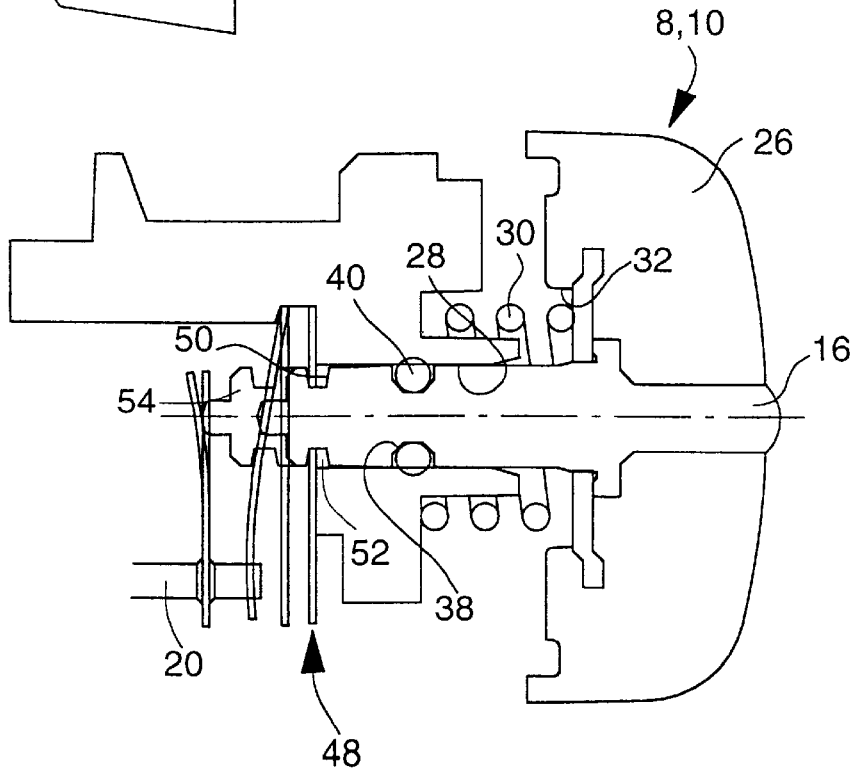
Fig. 4

MEANS FOR LOADING OR EXTRACTING DATA FROM A PORTABLE OBJECT, SUCH AS, IN PARTICULAR, A TIMEPIECE

The present invention concerns a portable object, such as, in particular, a timepiece, including means which allow data to be exchanged between the portable object and a personal computer or PC.

Timepieces such as wristwatches including a case inside which is housed, for example, a digital photographic device, are already known. The person wearing such a watch thus has a camera permanently available which allows him to take snapshots of a landscape, members of his family or a person he has met during a work meeting. Once the photographs are taken, they are digitised by an analogue/digital converter, then stored in a memory circuit.

The stored photographs then have to be transferred to a remote electronic receiver and processing unit, conventionally a personal computer. This transfer is effected via an electric cable one end of which is connected to the watch, and the other end of which is connected to the PC. An ohmic contact carried, for example, by the middle part of the watch, allows the image transfer cable to be connected to the latter.

This solution has the advantage of being economical from the point of view of electric power consumption. Indeed, the transmission of the digital data corresponding to the photographs stored in the memory via a cable link requires only a very low current. Moreover, during this transfer operation, the electric power supply of the watch can be assured by the computer itself which his generally connected to the electric mains supply.

However, a major drawback of transmission via a cable resides in the fact that the ohmic contact necessary for connecting the transfer cable is very detrimental to the watertightness of the watch. This contact in fact constitutes an opening through which humidity, water and dust can easily penetrate the case of the watch and compromise the proper operation of the latter.

A system for processing personal data is also known from U.S. Pat. No. 5,848,027 in the name of Biometrics, Inc. This system allows, for example, the performance of an athlete such as a runner to be monitored. It allows the data and time of the run to be stored, the time for each lap, or even the final time achieved by the sportsman. The system also allows the values of certain physiological parameters to be stored such as the heart rhythm or an electrocardiogram (ECG) which reflect the effort made by the athlete during his sporting activity. All this data will then be transmitted, via an acoustic link, to a personal computer in which the data will be processed, analyzed, then finally displayed on the screen of said computer.

The Biometrics system described above advantageously allows personal data to be stored in a watch, then this data to be transferred via acoustic waves to a computer where it will be processed and analyzed. This system is unfortunately not bi-directional. It is thus not possible to transfer data from the computer to the watch, which considerably limits the possible applications of the Biometrics system. Further, data transmission via acoustic waves is a technique which uses a lot of power and which requires relatively expensive components.

The object of the present invention is to overcome the above problems and drawbacks in addition to others by proposing a particularly simple and inexpensive system allowing data to be exchanged between a portable object such as a timepiece and a personal computer or PC.

The present invention therefore concerns a portable object such as, in particular, a timepiece, including an electronic movement carried by a printed circuit, this electronic movement including a time base circuit, a frequency divider circuit powered by the time base, a control circuit connected to the divider circuit and a display system controlled by the control circuit, this portable object also including at least one push-button including a head and a stem passing through the middle part of a case closed by a back cover, characterised in that the stem of the push-button can be electrically connected to a data input of the control circuit by pressing on the push-button, so that it is possible, via this stem, to enter data into said control circuit, originating from an electronic unit for transmitting and receiving digital data such as a personal computer or PC or to extract data contained in said portable object.

As a result of these features, an electric link is very simply established between the computer and the portable object. An electric cable, connected to the PC at one of its ends, comes in contact at its other end with the stem of the push-button which is itself directly connected to a data input of the control unit of the portable object. Such a solution is economical from the point of view of electric power consumption and does not require any complex, expensive mechanical or electronic components. In particular, it is not necessary to provide the portable object with an ohmic contact for connecting the cable. Thus full advantage is taken of all the benefits associated with the exchange of data via a cable link while avoiding the problems associated with this technique.

According to a complementary feature of the invention, the push-button also acts on the control circuit to correct an indication or to start or stop a particular horological function, for example time measurement, the push-button stem carrying, for this purpose, a contact spring which acts as a key to prevent said push-button being removed after it has been set in place and as a means for establishing an electric contact with a zone of the printed circuit, this contact spring being electrically insulated with respect to said stem.

As a result of these other features, data can be exchanged between the portable object and the computer using only the means which the portable object carries for adjusting and actuating its usual horological functions. It is thus no longer necessary to add additional parts to the portable object in order to be able to connect the control circuit of the watch to a PC. The construction of the watch is thus simplified, which substantially limits the manufacturing costs. Likewise, the sealing of the portable object is not altered.

Other features and advantages of the present invention will appear more clearly upon reading the following detailed description of an embodiment example of the portable object according to the invention, this example being given purely by way of illustrative and non limiting example in conjunction with the annexed drawings, in which:

FIG. 3 is a top view of a push-button;

FIG. 4 is a cross-section of the push-button of FIG. 3;

The present invention proceeds from the general inventive idea which consists in connecting an electronic unit for transmitting and receiving digital data, typically a personal computer, or PC, to an integrated circuit contained in a watch by using the push-buttons which such a watch has for controlling its usual horological functions. For this purpose, the PC is electrically connected to the push-buttons which, when pushed in, come into contact with an electric contact blade carried by the printed circuit of the watch and which is itself connected to the integrated circuit of the watch.

On the other hand, it will be noted that, although the present invention is described with reference to a timepiece, it also applies in an identical manner, to any portable object including an integrated circuit with a memory into which one wishes to enter or extract data from the exterior of said portable object.

Figure 1:
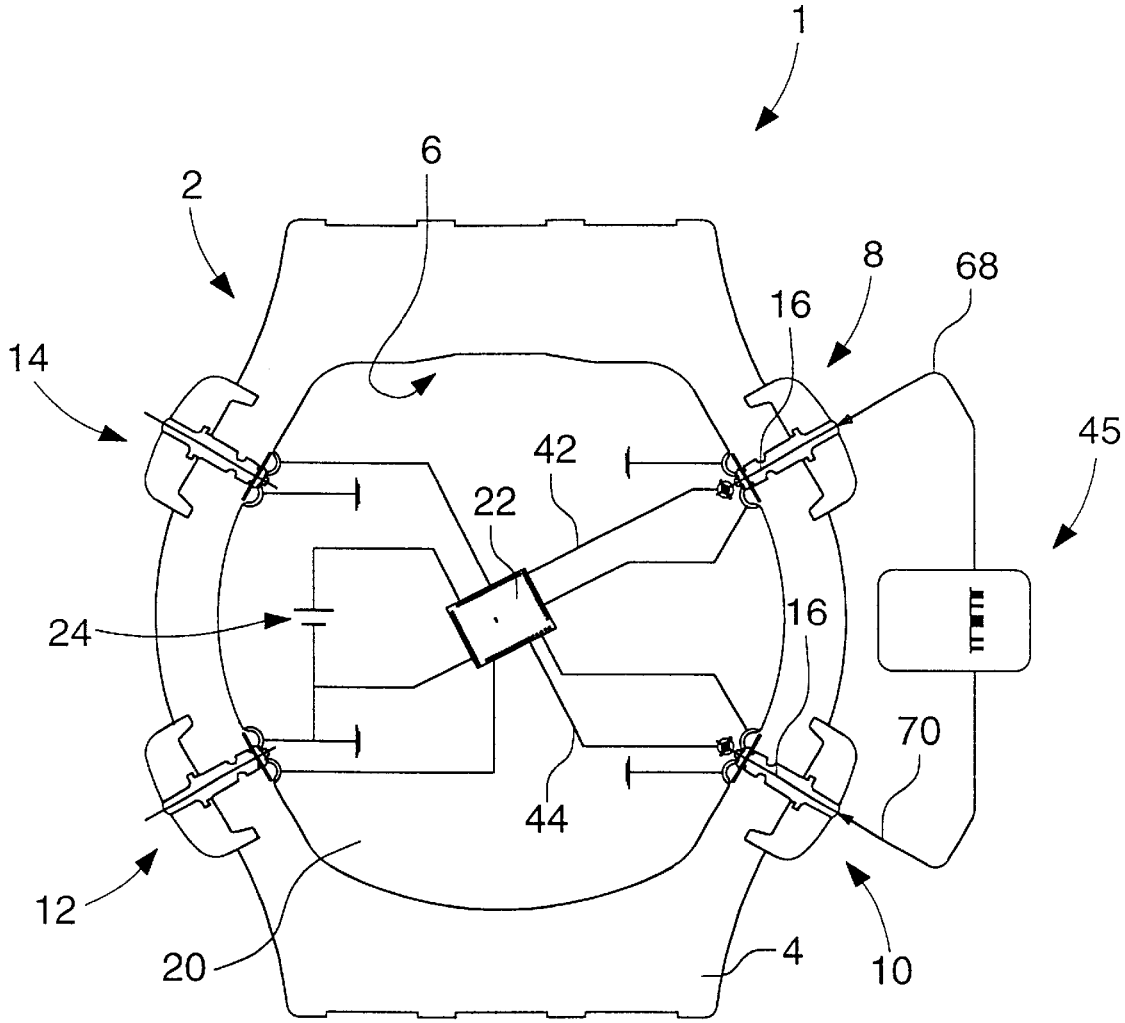
FIG. 1 is a top view of a timepiece according to the invention including four push-buttons.

The timepiece according to the invention may be, for example, a wristwatch. It is shown schematically in FIG. 1 and designated as a whole by the general reference numeral 1. It includes, in particular, a case 2 delimited by a middle part 4, which may or may not be metal, and a back cover 6.

Four push-buttons 8, 10, 12 and 14 pass through middle part 4. It goes without saying that this example is given purely by way of illustration and that, in order to implement the present invention, watch 1 need only include a single push-button. In the following description, one will concentrate solely on push-buttons 8 and 10. The two other push-buttons 12 and 14 may have the same structure as push-buttons 8 and 10 or have a different structure known to those skilled in the art. They will not, therefore, be described in more detail hereinafter.

Push-buttons 8 and 10 are principally formed of an elongated metal stem 16 preferably, but not exclusively, having a cylindrical shape. When middle part 4 of watch 1 is made of metal, stem 16 of push-buttons 8 and 10 passes through a sleeve 18 made of an electrically insulating material as shown schematically in FIG. 2. Sleeve 18 may be, for example, driven into middle part 4 of watch 1.

Middle part 4 of watch 1 defines a central cavity which houses, in a conventional manner, an electronic clockwork movement carried by a printed circuit 20. This clockwork movement includes, amongst others, a time base circuit, a frequency divider circuit powered by the time base, a control circuit connected to the divider circuit and a display system controlled by control circuit 22. The display system can be an analogue system including an hour hand, a minute hand and a second hand moving above a dial. The display system can also be formed by a digital liquid crystal display cell.

Control circuit 22 fulfils various functions. In particular, it maintains the oscillations of the quartz oscillator of the time base, divides the quartz frequency, corrects the working of the watch, powers, if required, the motors and liquid crystal displays, controls special functions, such as the date, the chronograph, the alarm, the time zones, and allows certain indications to be corrected and time-setting to be effected.

Control circuit 22 is supplied with current by an accumulator 24 intended to be recharged after it runs down. It goes without saying that control circuit 22 could also be powered by a non rechargeable battery. Accumulator 24, shown schematically in FIG. 1, typically has the shape of a button which can be housed in back cover 6 of watch 1. The bottom face of accumulator 24 which constitutes its negative pole is electrically connected to metal back cover 6 and thus to metal middle part 4, i.e. the earth of watch 1, for example via a contact spring fixed to the inner surface of back cover 6 of said watch 1. The positive pole of accumulator 24 which is formed by its top face is, in the usual manner, connected to a supply terminal of control circuit 22.

Of course, the watch, in particular back cover 6 and middle part 4 thereof, can be made of an electrically insulating material such as a plastic material. In such case, the poles of accumulator 24 are directly connected to the supply terminals of control circuit 22.

It also goes without saying that the poles of accumulator 24 may be reversed, the bottom face of the round button forming its positive pole, and the negative pole being then situated on the top of this button. In such case, the positive pole is electrically connected to the earth of watch 1.

Figure 2:
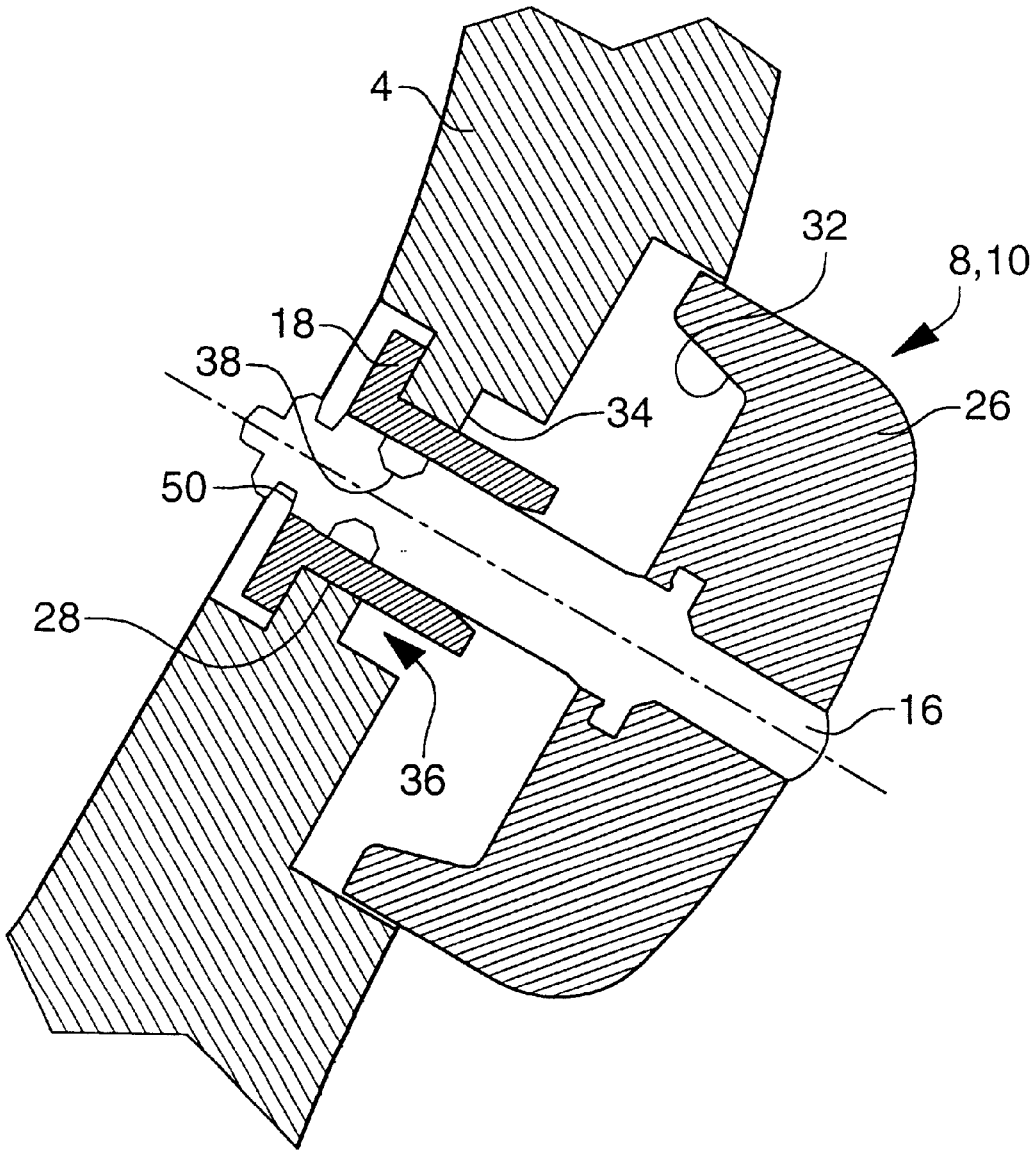
FIG. 2 is a detailed view on a larger scale of one of the push-buttons of FIG. 1.

As shown more particularly in FIGS. 2 to 4, push-buttons 8 and 10 each include a push-button head 26 and metal push-button stem 16. Push-button stem 16 is arranged so as to slide inside a housing 28 of generally cylindrical shape arranged in middle part 4 of watch 1. Push-button stem 16 moves axially in housing 28 against the return force of a spring 30 when a control push is applied to push-button head 26.

Return spring 30 is arranged in a housing 32 arranged in push-button head 26 and rests axially on the bottom 34 of a cavity 36 provided in middle part 2. Push-button stem 16 has at one place on its length an annular groove 38 in which is housed a sealing gasket 40. This sealing gasket 40 assures the watertight sealing of housing 32 when stem 16 slides therein during actuation of push-buttons 8 and 10 by a user.

According to a simplified alternative embodiment of the present invention, push-buttons 8 and 10 described above are used only for entering or extracting data from watch 1. For this purpose, they include holding means such as a key which prevents only the removal of push-buttons 8 and 10 after they have been set in place in middle part 4 of watch 1. In accordance with the main feature of the invention, stems 16 of the two push-buttons 8 and 10 can be electrically connected to two data inputs, respectively 42 and 44, of control circuit 22 by pressure on said push-buttons 8 and 10. It is thus possible, as will be seen in detail hereinafter, to connect an electronic digital data transceiver unit 45 such as a personal computer or PC to control circuit 22 of watch 1 in order to enter data from the PC into said control circuit 22 or to extract data contained in watch 1. For this purpose, the end of stem 16 located inside case 2 touches, during pressure on the corresponding push-button 8, 10, a contact blade or strip 46 carried by printed circuit 20 and connected to one of the data inputs respectively 42 and 44 of control circuit 22.

Figure 7:
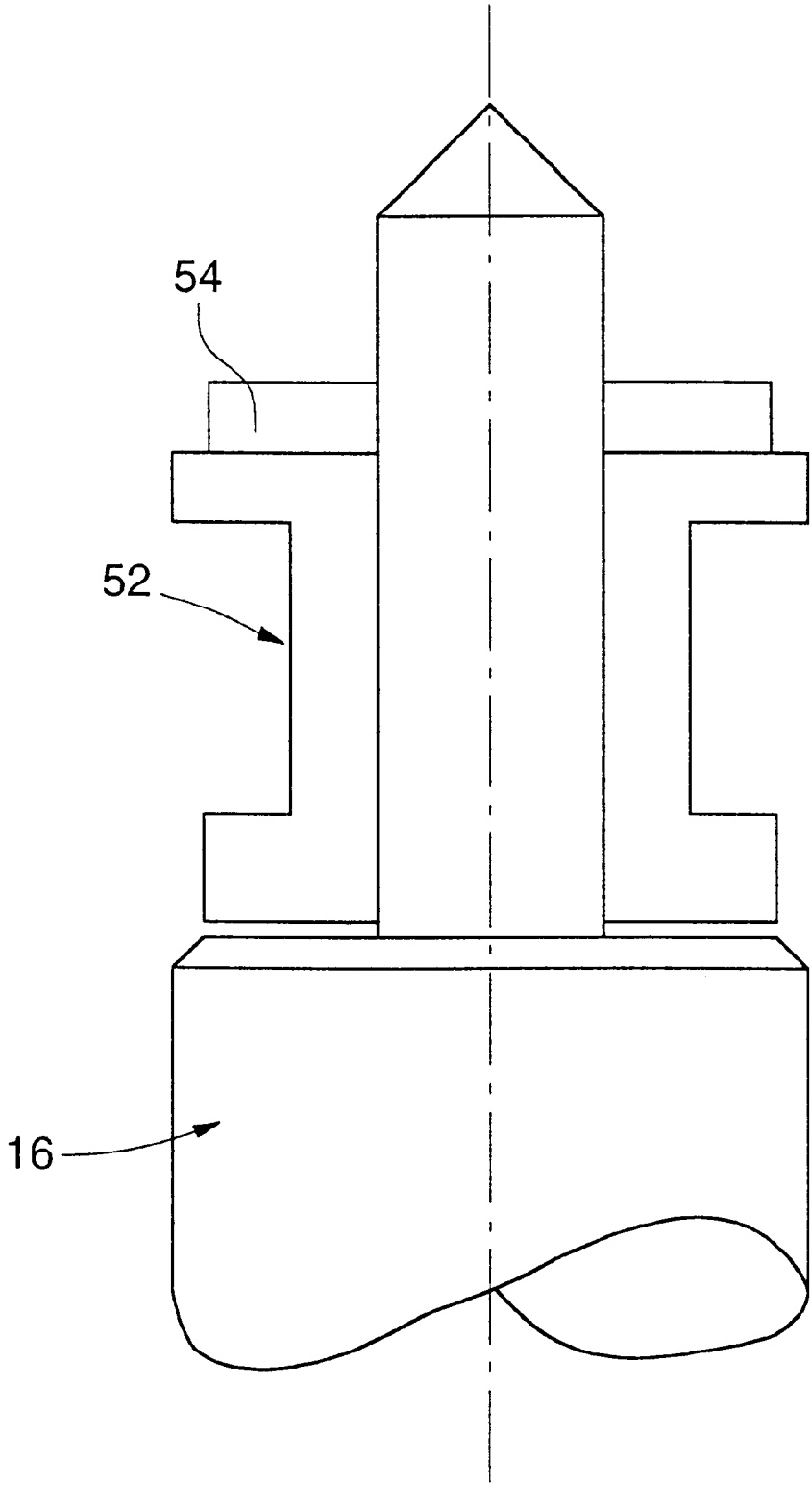
FIG. 7 is a cross-section in an insulating sleeve through which the contact spring is mounted on the push-button stem.

According to the preferred embodiment of the invention, push-buttons 8 and 10 are used not only for entering or extracting data from watch 1, but also for correcting data or for starting or stopping a particular horological function, for example time measurement. Thus, push-buttons 8 and 10 include a contact spring 48 which exerts sufficient force on push-button stem 16 to act against the return force of spring 30 and thus to prevent said stem 16 from escaping from housing 28 in which it slides. Contact spring 48 is a W-shaped key which is engaged in an annular groove 50 of a sleeve 52 (see in particular FIG. 7) mounted onto the end of stem 16 opposite push-button head 26. Sleeve 52 is made of an insulating material such as a ceramic material or a plastic material and is held by a washer 54 driven onto push-button stem 16 after said sleeve 52. Contact spring 48 is thus electrically insulated with respect to push-button stem 16. In normal use conditions, contact spring 48 is always pressed against the inner face of middle part 4 of watch 1. It only moves when a control push is applied to one or other of push-buttons 8, 10.

Figure 5:
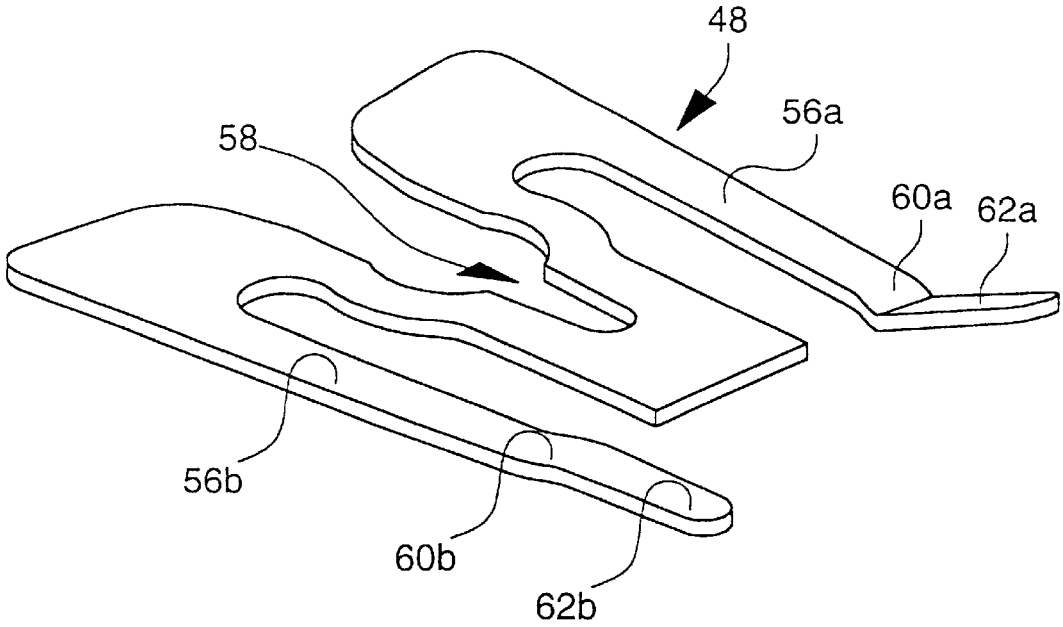
FIG. 5 is a perspective view of a contact spring mounted on the stem of a push-button.
Figure 6:
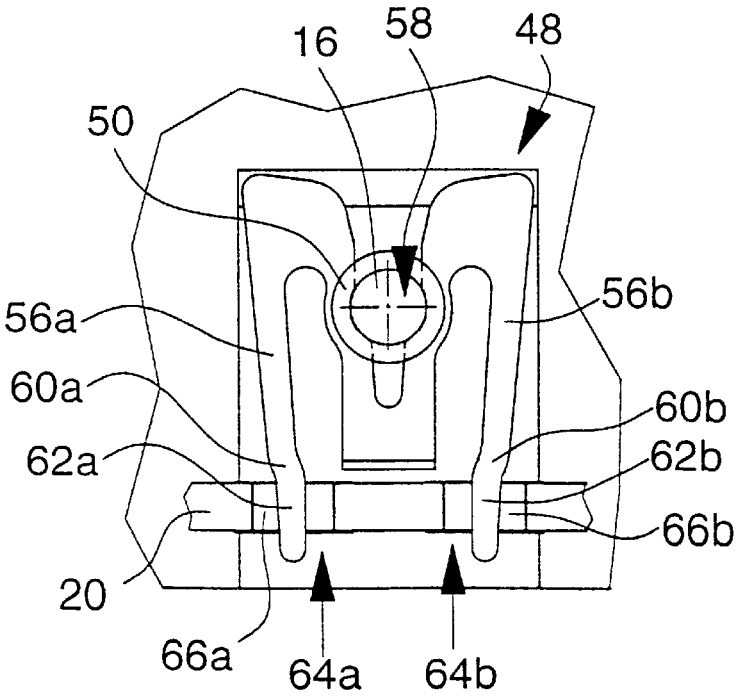
FIG. 6 is a front view of the contact spring of FIG. 5.

Contact spring 48 is obtained by cutting out or stamping a metal sheet along a particular contour and by folding so as to exert, after it has been set in place, both the function of a key and contact means. Contact spring 48 is thus formed of two strips 56*a,* 56*b* extending in the general plane of said contact spring 48. These two strips 56*a,* 56*b* are connected to each other in the top part by a V-shaped notch 58 intended to engage in annular groove 50 of insulating sleeve 52 to form a key. Towards the bottom, each of strips 56*a,* 56*b* is extended beyond a fold 60*a,* 60*b* by a small bent contact lug 62*a,* 62*b*. It is clearly shown in FIG. 5 that contact lug 62*a* is projected at a certain angle outside the general plane of contact spring 48 to establish a contact, for example an earth contact, over a zone of printed circuit 20 as will be seen hereinafter.

Printed circuit 20 on which control circuit 22 is mounted, includes two contact pads 64*a,* 64*b* which are each formed of a semi-cylindrical hole with a metallised vertical wall 66*a,* 66*b* arranged facing the respective contact lugs 62*a,* 62*b* of contact spring 48. One of these holes is electrically connected to control circuit 22, while the other hole is connected to the earth of watch 1.

When control pressure is exerted on one of push-buttons 8 or 10, contact spring 48 moves and its contact lugs 62*a,* 62*b* touch metallised holes 64*a,* 64*b*. As described hereinbefore, contact lug 62*a* is projected outside the general plane of contact spring 48. Thus, when one of push-buttons 8 or 10 is pushed in, this contact lug 62*a* comes into contact with metallised hole 64*a* which faces it before the other contact lug 62*b* itself touches the metallised hole 64*a* which corresponds thereto, which prevents the electrostatic discharges which are particularly harmful to control circuit 22.

When the two contact lugs 62*a,* 62*b* touch the metallised holes 64*a,* 64*b,* there is a short-circuit between these two holes 64*a,* 64*b,* which causes the arrival of an instruction to control circuit 22. Conversely, when watch 1 according to the invention is connected to computer 45, push-buttons 8 and 10 remain pushed for the entire time that data is exchanged between said watch 1 and said computer 45. Control circuit 22 is programmed so that it then understands that this situation does not correspond to the activation or deactivation of an horological function of watch 1, but to the entry of data from PC 45 into control circuit 22 or the extraction of data contained in watch 1. When push-buttons 8, 10 are pushed in, they are electrically connected to the data inputs respectively 42 and 44 of control circuit 22 via contact strips 46. One may imagine that push-button 8 is used for transferring data from electronic unit 45 to control circuit 22 of watch 1 and that, conversely, push-button 10 is used for transferring data from watch 1 to electronic unit 45. However, according to an alternative embodiment, a single push-button can be used for the bi-directional exchange of data between watch 1 and electronic unit 45. For this purpose, electronic unit 45 need only indicate to control circuit 22, using a suitable computer programme, that it is ready to receive the data from said control circuit 22.

As already described hereinbefore, push-buttons 8, 10 are electrically connected to the data inputs respectively 42 and 44 of control circuit 22 via pressure on these push-buttons 8, 10.

In order to enter or extract data from control circuit 22 of watch 1, the electronic unit or computer 45 is provided with two electric plugs 68 and 70 which come into contact with said push-buttons 8 and 10 respectively. According to a first alternative embodiment, push-buttons 8 and 10 include a metal push-button head 26 driven onto push-button stem 16. It must then be ensured that this metal push-button head 26 does not short-circuit with its surroundings.

Figure 8:
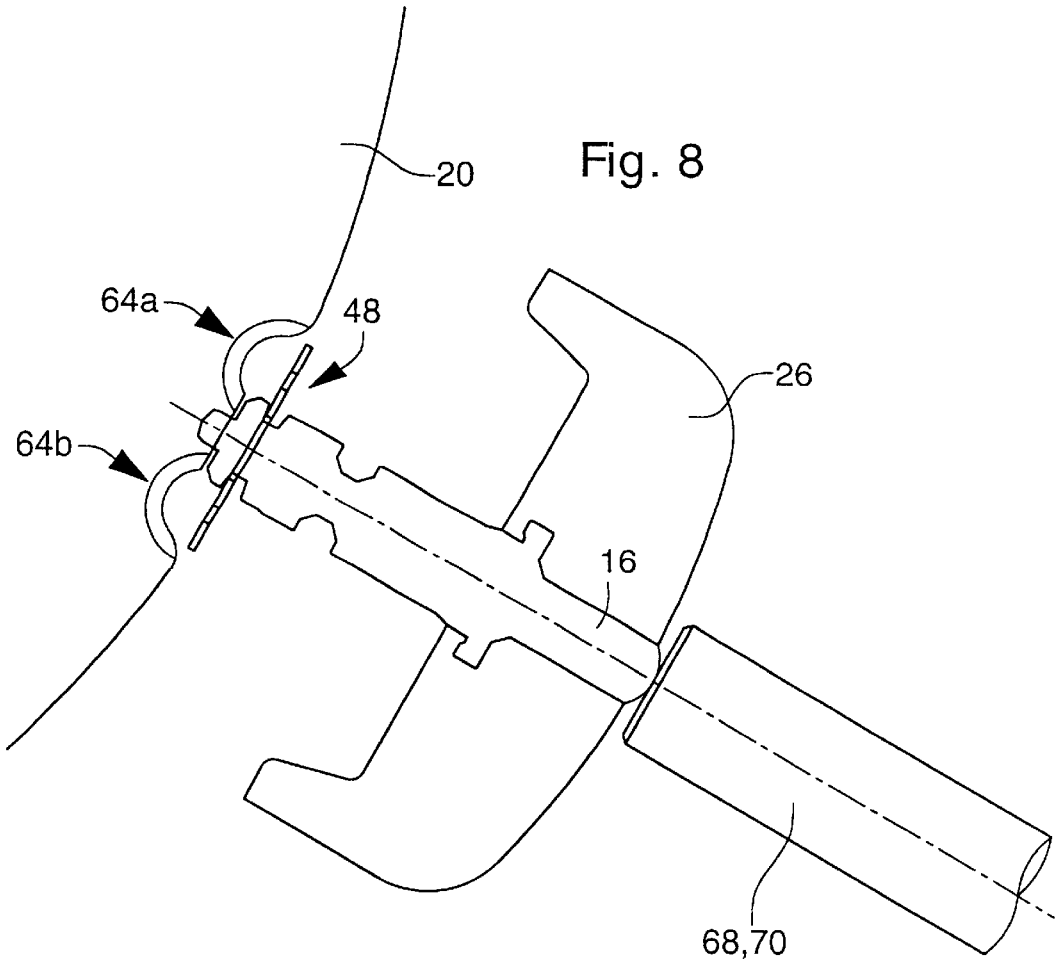
FIG. 8 is a cross-section of a first alternative embodiment of a push-button.

According to a second alternative embodiment shown in FIG. 8, push-button head 26 is made of an injection moulded plastic or elastomeric material so as to bond to push-button stem 16. As FIG. 8 shows, metal push-button stem 16 is flush with push-button head 26 or projects slightly from the surface of said push-button head 26, so that the electric contact can be established with electric plugs 68, 70 of personal computer 45.

Figure 9:
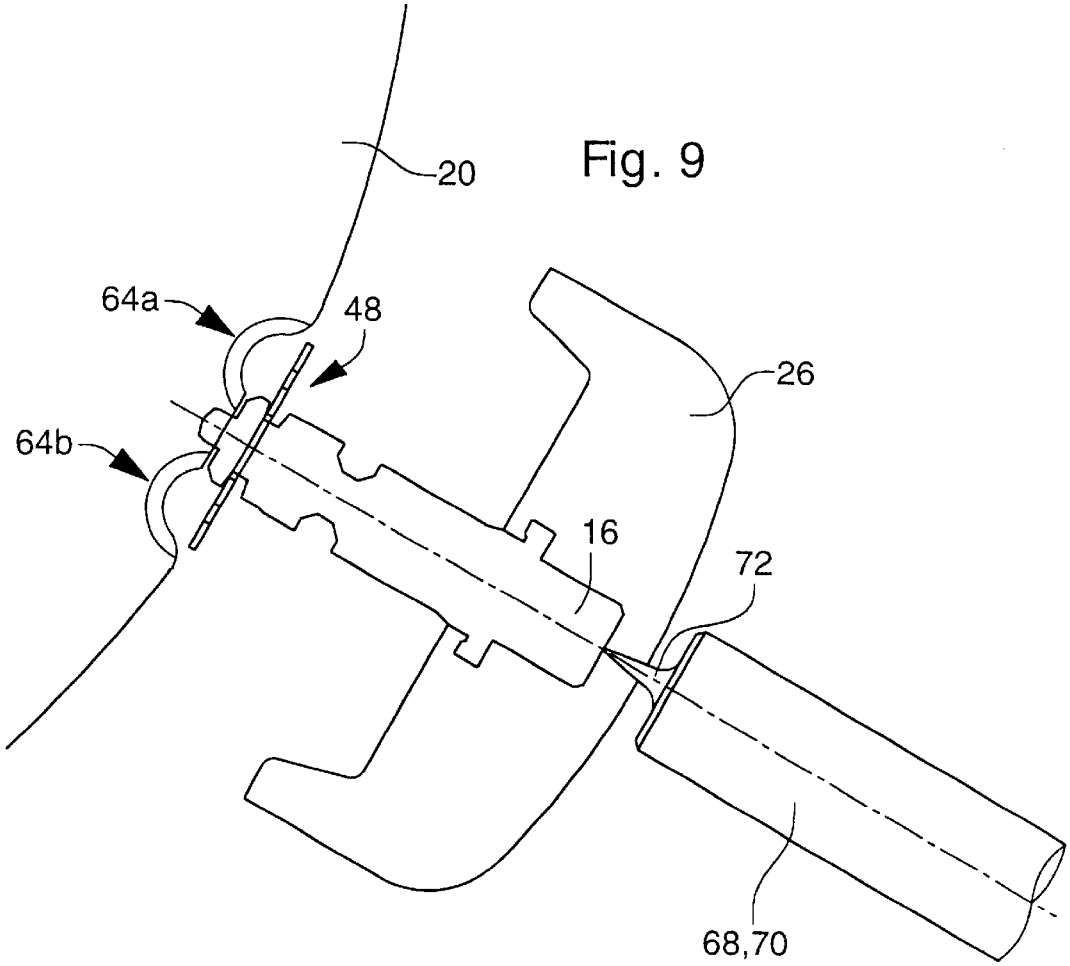
FIG. 9 is a cross-section of a second alternative embodiment of a push-button.

According to another alternative embodiment shown in FIG. 9, push-button stem 16 is embedded in push-button head 26 which is made of a relatively soft plastic or elastomeric material. Electric plugs 68, 70 of electronic unit 45 then have a pointed end 72 which is capable of easily penetrating the soft material of which push-button head 26 is made and coming into electric contact with push-button stem 16.

Figure 10:
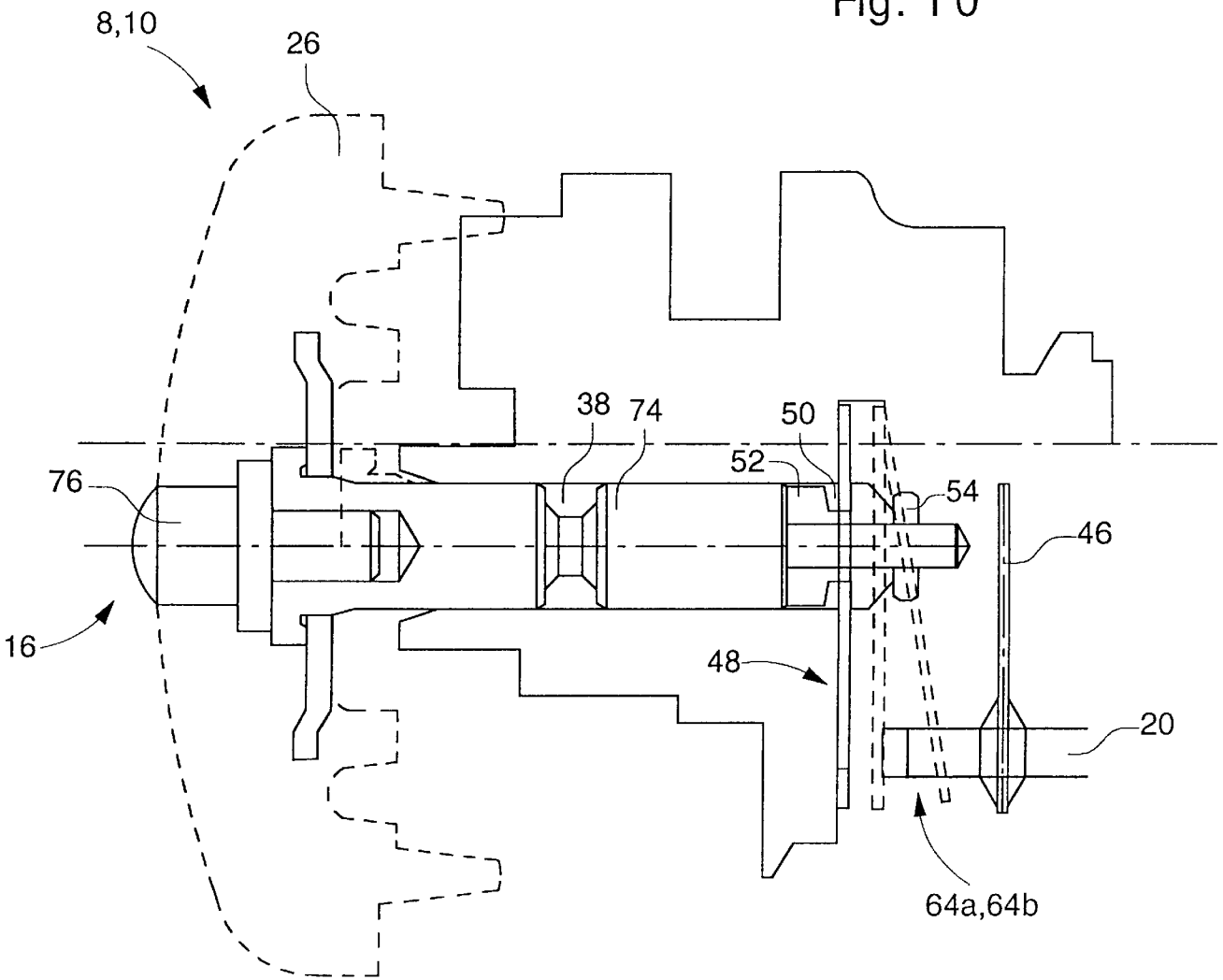
FIG. 10 is a cross-section of the push-button stem.

Push-button stem 16 may be made in a single part. However, according to a preferred embodiment of the invention shown in FIG. 10, push-button stem 16 is formed of two parts 74 and 76, one pierced part 74 made of ordinary stainless steel 4C27A, and the other 76, driven into the pierced portion of the first and made of performing stainless steel 316L to prevent any corrosion via the effect of perspiration or friction produced by contact with electric plugs 68, 70 of electronic unit 45.

It goes without saying that various simple variants and modifications fall within the scope of the present invention. In particular, it will be understood that contact spring 48 described hereinabove which acts both as a key for preventing push-button 8, 10 from being removed and as means for establishing an electric contact with a zone of printed circuit 20 may be replaced by two separate parts, one being used to keep push-button stem 16 in position, and the other assuring the electric contact with contact pads 64*a,* 64*b* of printed circuit 20.

What is claimed is:

1. A portable object such as, in particular, a timepiece, including an electronic movement carried by a printed circuit, this electronic movement including a time base circuit, a frequency divider circuit powered by the time base circuit, a control circuit connected to the divider circuit and a display system controlled by the control circuit, this portable object also including at least one push-button including a head and a stem passing through a middle part of a case closed by a back cover, wherein the push-button stem can be electrically connected to a data input of the control circuit by pressing on the push-button, so that it is possible, via this stem, to enter data into said control circuit, originating from an electronic unit for transmitting and receiving digital data such as a personal computer or PC or to extract data contained in said portable object.

2. A portable object according to claim 1, wherein the push-button further acts on the control circuit to correct an indication or to start or stop a particular horological function, for example time measurement, the push-button stem carrying for this purpose a contact spring which acts as a key to prevent said push-button from being removed after it has been set in place and as means for establishing an electric contact with a zone of the printed circuit, this contact spring being electrically insulated with respect to said stem.

3. A portable object according to claim 2, wherein, when the push-button is pushed in, the end of the stem located inside the case touches a contact strip fixed to the printed circuit, this contact strip being itself connected to the data input of the control circuit.

4. A portable object according to claim 2, wherein a sleeve made of an insulating material is mounted over the end of the stem located inside the case, this sleeve carrying the contact spring and being held by a washer driven onto said stem after said sleeve.

5. A portable object according to claim 4, wherein the sleeve is made of a ceramic material or a plastic material.

6. A portable object according to claim 1, wherein the push-button stem is formed of two parts, one pierced part made of stainless steel 4C27A, and the other, driven into the pierced portion of the first and made of stainless steel 316L to prevent any corrosion via the effect of perspiration or friction.

7. A portable object according to claim 2, wherein the contact spring is a W-shaped key.

8. A portable object according to claim 7, wherein the contact spring includes two strips extending in the general plane of said contact spring, these two strips being connected to each other in their top part by a V-shaped notch and each being extended downwards, beyond a fold, by a bent contact lug.

9. A portable object according to claim 8, wherein one of the contact lugs projects at an angle outside the general plane of the contact spring.

10. A portable object according to claim 1, wherein the push-button stem is metal.

11. A portable object according to claim 10, wherein the push-button head is metal and is driven onto the push-button stem.

12. A portable object according to claim 10, wherein the push-button head (26) is made of a plastic or elastomeric material and in that the push-button stem is flush with the push-button head or projects slightly from said push-button head.

13. A portable object according to claim 10, wherein the push-button stem 16 is embedded in the push-button head made of a relatively soft plastic material or elastomeric material and in that one of the electric plugs of the electronic unit intended to transfer data to the portable object or vice versa has a pointed end which is capable of penetrating the soft material of which the push-button head is made and coming into electric contact with the push-button stem.

14. A portable object according to claim 1, wherein the push-button stem is arranged so as to slide inside a housing arranged in the middle part of said portable object, and in that a return spring is arranged in a housing arranged in the push-button head and rests axially on the bottom provided in said middle part.

15. A portable object according to claim 2, wherein the printed circuit has two contact pads arranged respectively facing contact lugs of the contact spring.

16. A portable object according to claim 15, wherein the contact pads are each formed of a cylindrical semi-hole with a metallised vertical wall, one of these holes being connected to the control circuit of said portable object, and the other hole being connected to the earth of the portable object.

* * * * *